US008379895B2

(12) United States Patent
Gebert et al.

(10) Patent No.: US 8,379,895 B2
(45) Date of Patent: Feb. 19, 2013

(54) HEARING AID DEVICE

(75) Inventors: Anton Gebert, Kleinsendelbach (DE); Andreas Ratay, Herzogenaurach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1138 days.

(21) Appl. No.: 11/975,329

(22) Filed: Oct. 18, 2007

(65) Prior Publication Data

US 2008/0095390 A1 Apr. 24, 2008

(30) Foreign Application Priority Data

Oct. 18, 2006 (DE) ..... 10 2006 049 661

(51) Int. Cl.
*H04R 5/02* (2006.01)

(52) U.S. Cl. ..... 381/322

(58) Field of Classification Search ..... 381/322–325
See application file for complete search history.

(56) References Cited

U.S. PATENT DOCUMENTS

| | | | | |
|---|---|---|---|---|
| 3,408,461 | A | 10/1968 | Langford | |
| 4,987,597 | A * | 1/1991 | Haertl | 381/325 |
| 6,041,128 | A * | 3/2000 | Narisawa et al. | 381/322 |
| 2004/0179709 | A1 | 9/2004 | Niederdränk et al. | |
| 2006/0159298 | A1 * | 7/2006 | von Dombrowski et al. | 381/330 |
| 2007/0206826 | A1 | 9/2007 | Röhrlein | |

FOREIGN PATENT DOCUMENTS

| | | | |
|---|---|---|---|
| DE | 298 01 567 | U1 | 5/1998 |
| DE | 10 2004 044 318 | B1 | 11/2005 |
| DE | 102 60 307 | B4 | 2/2007 |
| DE | 10 2006 008 044 | B3 | 5/2007 |
| EP | 1257151 | A2 | 11/2002 |
| WO | 0143499 | A1 | 6/2001 |

* cited by examiner

*Primary Examiner* — Jianchun Qin

(57) ABSTRACT

With a hearing aid device having a device element which can be worn on or behind the ear and an earmold which protrudes at least partially into the auditory canal of a user, in which earmold a receiver is arranged, the protection of the receiver from contamination is to be improved. To this end, a sound outlet opening in the earmold is covered with a membrane and a ventilation channel is provided for the rear ventilation of the membrane, with at least one segment of the ventilation channel running in a connecting piece, which connects the device element to the earmold.

13 Claims, 2 Drawing Sheets

HEARING AID DEVICE

CROSS REFERENCE TO RELATED APPLICATIONS

This application claims priority of German application No. 102006049661.2 DE filed Oct. 18, 2006, which is incorporated by reference herein in its entirety.

FIELD OF INVENTION

The invention relates to a hearing aid device which can be worn on the head of a user having a device element which can be worn on or behind the ear of a user, an earmold which can be inserted at least partially into the auditory canal of the user and a connecting piece connecting the device element with the earmold, with the hearing aid device comprising at least one input converter for recording an input signal and converting said signal into an electrical input signal, a signal processing unit for processing and amplifying the electrical input signal and for generating an electrical output signal, a receiver for converting the electrical output signal into an acoustic output signal as well as a voltage source for supplying power to the hearing aid device, with the signal processing unit being arranged in the device element and the receiver being arranged in the earmold and with the connecting piece comprising electrical conductors to electrically connect the signal processing unit to the receiver.

BACKGROUND OF INVENTION

DE 29801567 U1 discloses a hearing aid device which can be worn behind the ear, having an earmold which can be inserted into the auditory canal of a user and a flexible mounting bracket connecting the hearing aid device to the earmold, with which the receiver is arranged in the earmold and the mounting bracket comprises electrical conductors to connect the receiver to the hearing aid device which can be worn behind the ear. The mounting bracket is also connected in a detachable fashion both to the hearing aid device, which can be worn behind the ear, and to the earmold by means of a jack socket and jack plug.

With hearing aid devices, an acoustic tube usually leads from the sound outlet support of the receiver to the sound outlet opening of the hearing aid device. To protect against contamination, the sound outlet opening of a hearing aid device is frequently provided with a cerumen protection facility. If a membrane and in particular a closed, i.e. non-porous membrane is used as a cerumen protection facility, an air vent is required for the enclosed volume between the receiver and the membrane for barometric pressure equalization purposes. This rear ventilation of the closed membrane ensures that the static pressure on both sides of the membrane is equal and corresponds to the ambient air pressure. A hardening of the membrane with the resulting acoustic disadvantages is hereby avoided.

The receiver itself also requires a rear ventilation of the receiver membrane for barometric pressure equalization of the enclosed volume between the receiver membrane rear side and the receiver housing and not connected with the sound outlet opening of the receiver. For this purpose, an opening is provided in the housing of the receiver, typically in the form of a high-precision borehole. A connecting channel can also be present, which connects the volumes on both sides of the receiver membrane with one another. In the simplest case, this connecting channel is generated by at least one small hole in the receiver membrane. The borehole in the receiver housing as well as the holes in the receiver membrane must be small in order to avoid acoustic feedback and to not unnecessarily reduce the level of efficiency of the receiver. They acoustically represent a low pass with a typical cut-off frequency in the range of 1 Hz or an acoustic voltage divider with a strong attenuation.

If a receiver has both a ventilation opening in the receiver housing and also a ventilation channel between the two sides of the receiver membrane, the barometric pressure equalization is in principle thus also possible for cerumen protection between the receiver and an air-tight membrane.

Hearing device receivers and in particular ventilation boreholes of receivers of this type are heavily susceptible to contamination, for which reason the air ventilation is usually routed into the interior part of the hearing aid device, in which a relevant receiver is used. The surrounding hearing aid device housing protects the small borehole from direct contact and/or from a direct connection with the auditory canal, in which the relevant hearing aid device is used. The air exchange with the exterior air which is required for the barometric pressure equalization is then carried out by way of leaks in the hearing aid device housing which are already present, in the region of the battery compartment or operating elements for instance.

SUMMARY OF INVENTION

With hearing aid devices which can be worn behind the ear, in which the receiver is disposed in an earmold which can be worn in the auditory canal, either no housing surrounding the receiver is present (the receiver housing forms as it were the housing of the earmold) or the housing is guided very closely around the receiver. A correspondingly large "prechamber" is thus missing for the barometric pressure equalization, which accumulates the dirt and herewith prevents the small borehole from becoming blocked.

The object of the present invention is thus to improve the rear ventilation of a receiver for the barometric pressure equalization in a hearing aid device with a device element which can be worn outside the auditory canal and an earmold which can be worn in the auditory canal, in which the receiver is also disposed. This object is achieved by a hearing aid device with the features of the independent claims.

The hearing aid device according to the invention can be subdivided into at least three segments. On the one hand, a relatively large device element which can be worn on or behind the ear exists. The device element includes at least the signal processing unit which is usually embodied as a digital signal processor. Further hearing aid device components, such as at least one microphone for recording an acoustic input signal and converting said signal into an electrical input signal, an antenna or coil for recording an electromagnetic input signal and converting said signal into an electrical signal as well a as a voltage source (battery or accumulator) for supplying power to the electronic components of the hearing aid device are accommodated in the device element. In addition, operating elements (on/off switch, alterable switch, volume control etc.) can also be disposed on the housing of the device element. Furthermore, the hearing aid device according to the invention includes an earmold which protrudes at least partially into the auditory canal of the user when the hearing aid device is being worn, in which earmold the receiver for converting the electrical output signal generated by the signal processing unit into an acoustic output signal is disposed. The earmold itself can comprise a housing which is adjusted to the individual anatomical factors of the user or a universally suitable housing. The earmold can also be provided with a holding element, e.g. a so-called "olive" for fastening the earmold and for sealing the auditory canal. In particular, in order to achieve a so-called "open supply", in which the auditory canal of the user is, as far as possible, not sealed by the earmold, the earmold can essentially also only consist of the receiver encased with a plastic coating.

The device element and the earmold are connected to one another by way of a connecting piece, in which the electrical conductors are guided for electrical connection of the signal processing unit with the receiver. The holding function for the device element which can be worn behind the ear is usually also attributed to the connecting piece. To this end, the connecting piece is preferably elastically deformable and comprises a specific rigidity. By virtue of its holding function, it can also be referred to as "mounting bracket".

Theoretically, the entire housing of the hearing aid device could be designed in one piece. In order to optimize the production outlay, it is however advantageously composed of three components which have already been mentioned: device element, earmold and connecting piece, which are joined together in a detachable or non-detachable fashion. With a detachable connection, screw joints, clamped joints, snap-on connections, locking connections or other connections are advantageously possible. A non-detachable connection is produced for instance by bonding the relevant components together.

The earmold of the hearing aid device according to the invention comprises a sound outlet opening, by way of which the sound generated by the receiver is output into the auditory canal of the user. In order to protect against contamination, this sound outlet opening is advantageously provided with a cover. If a microporous membrane or a closed membrane made of metal, metal alloy or an elastic plastic for instance is used, the infiltration of moisture in addition to the infiltration of dirt can be prevented. The membrane is preferably attached to a support, e.g. a plastic ring, and is herewith detachably connected to the earmold. A plurality of different connecting techniques can also be used here to generate a detachable connection, e.g. screw joints, clamped joints, snap-on connections, locking connections or other connections. The membrane can however also be bonded to the earmold, thereby rendering a non-destructive exchange impossible.

With the use of an air-impermeable membrane and a tight fitting of the receiver in the earmold, e.g. with a receiver embedded in the plastic material of the earmold, the problem arises that a suitable rear ventilation has to be ensured for the enclosed volume between the receiver and the cerumen protection membrane. An opening in the earmold could be provided herefor. However, this must then be provided with an air-permeable cover in order to protect against contamination and moisture.

The basic idea behind the invention consists in executing a rear ventilation of the receiver and in particular of the enclosed volume between the receiver and the cerumen protection membrane by way of a channel, which connects the earmold with the interior of the housing of the device element. This is advantageous in that the earmold can be designed to be air and water tight and that the openings present in the housing of the receiver or in the receiver membrane for the required barometric pressure equalization are effectively protected against moisture and contamination. The housing of the device element thus functions as an accumulator for infiltrating contamination and herewith prevents the pressure equalization openings of the receiver from becoming blocked.

BRIEF DESCRIPTION OF THE DRAWINGS

The invention is described in more detail below with reference to exemplary embodiments, in which.

DETAILED DESCRIPTION OF INVENTION

Figure 1:
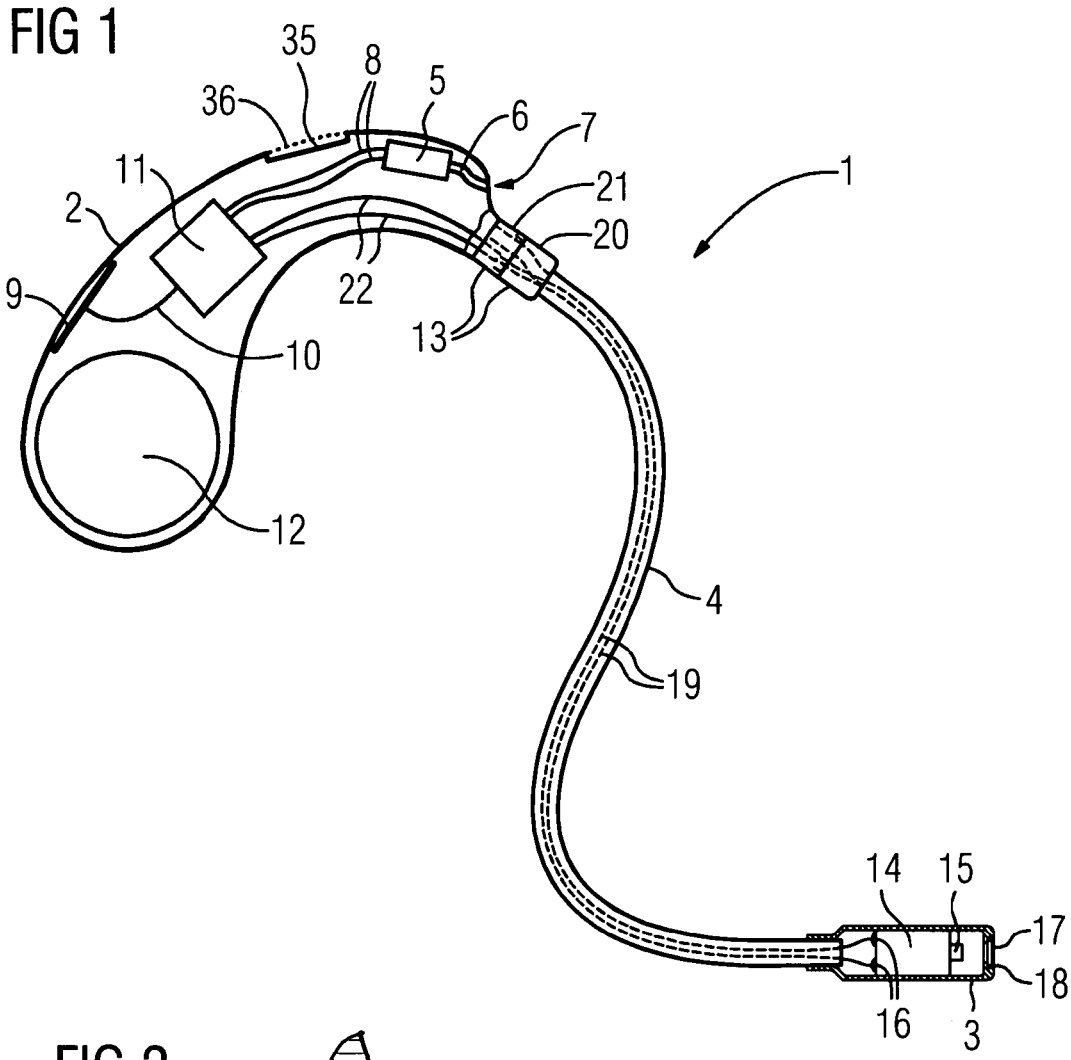
FIG. 1 shows a hearing aid device having a device element, an earmold and a connecting piece.

Externally, the hearing aid device 1 according to the exemplary embodiment is composed of the three segments; device element 2, earmold 3 and connecting piece 4. The device element 2 is designed to be worn behind the ear of a user and the earmold 3 with the receiver 14 contained therein is inserted into the auditory canal of the user when being worn. The earmold 3 is dimensioned such that it does not seal the auditory canal of the user. The hearing aid device 1 is thus designed for the "open supply" of the user. The device element 2 includes a microphone 5, which records an acoustic input signal by way of an acoustic channel 6 and a housing opening 7. In order to protect against contamination, the housing opening 7 can be provided with an air-permeable cover. The microphone 5 converts the acoustic input signal into an electrical input signal, which is fed to a signal processing unit 11 by way of electrical conductors 8. The processing and preferably frequency-dependent amplification of the electrical input signal is herewith carried out in order to generate an electrical output signal, which is fed to the receiver 14 by way of electrical conductors 19 and 22. Aside from the microphone 5, the hearing aid device 1 according to the exemplary embodiment includes an antenna 9 as a further signal input, by way of which the electromagnetic input signals are recorded and fed to the signal processing unit 11 by way of the electrical connecting line 10. An adjustment of the signal processing in the signal processing unit 11 by the user is also possible by way of this signal path, in conjunction with a remote controller for instance. A battery or accumulator 12 are used to supply power to the hearing aid device 1. In order to ventilate the device element 2, its housing includes a housing opening 35, which is covered with an air-permeable membrane 36.

The receiver 14 converts the electrical output signal fed via the electrical conductors 19 and 22 and the electrical receiver connecting contacts 16 into an acoustic output signal and outputs this via the sound outlet opening 15 of the receiver 14. To protect the receiver 14 against contamination and infiltrating moisture, the earmold 3 comprises a moisture and air-impermeable membrane 17. In the exemplary embodiment, this is fastened to a membrane support 18, which is inserted into the earmold 3 in a detachable fashion. The membrane can herewith be exchanged using a suitable tool.

In the exemplary embodiment, the earmold 3 is designed for an open adjustment and is thus relatively small. Similarly in another embodiment (not shown), the earmold could, to a large extent, at least seal the auditory canal of the user and in particular also be adjusted to the individual anatomical factors. In addition, the hearing aid device 11 in the exemplary embodiment according to FIG. 1 only shows one detachable connection between the connecting piece 4 and the device element 2. However, a detachable connection could also likewise be provided between the device element 4 and the earmold 3. In the exemplary embodiment, the connecting piece 4 is essentially embodied as an elastically deformable tube having electrical conductors 19 running in said tube. The non-detachable connection between the tube and the earmold 3 can be embodied as a bonded connection for instance.

Figure 2:
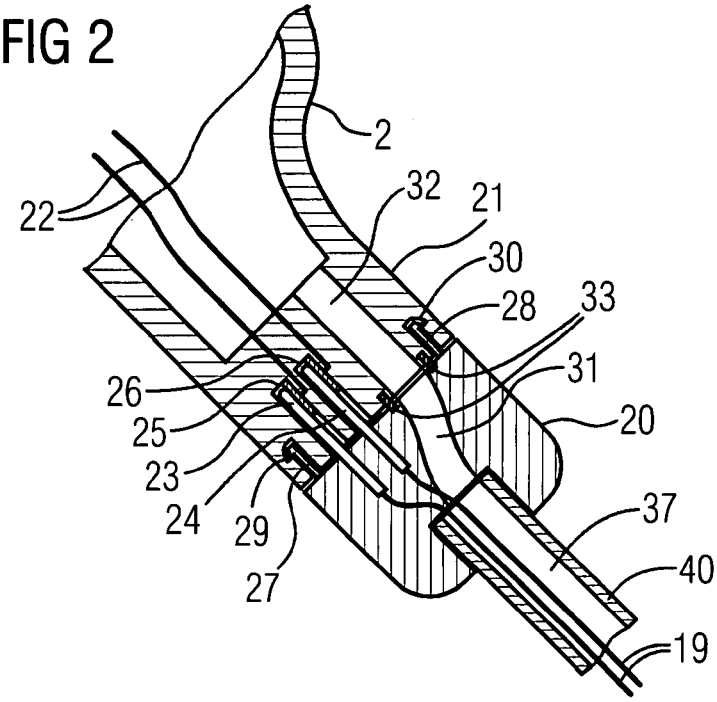
FIG. 2 shows a connecting facility for the detachable connection of the connecting piece with the device element.

FIG. 2 shows by way of example one possible embodiment of the connecting facility 13 for the detachable connection of the connecting piece 4 with the device element 2. As a continuous ventilation channel is generated between the interior space of the device element 2 and the interior space of the earmold in the exemplary embodiment according to the invention, the connecting facility 14 must also comprise a segment of the said channel in addition to the electrical contacts. The connecting facility includes a plug 20 as well as a socket 21. The plug 20 forms one end of the connecting piece 4. This is fixedly connected to the elastically deformable tube 40. The two contact pins 23 and 24 are cast in the plug 30. The two contact pins 23 and 24 are connected to the electrical conductors 19, which are guided through the tube 40. In order to produce a detachable connection of the plug 20 with the socket 21, the plug 20 includes latches 27 and 28, which lock into correspondingly shaped recesses 29 and 30 in the socket 21. The plug 20 can herewith be separated from the socket 21 by exerting an external force. In addition, the plug 20 comprises a ventilation channel 31, which continues the ventilation channel 37 formed by the tube 40. The socket 21 also comprises a ventilation channel 32, so that the ventilation channel 37 continues over the ventilation channel 31 of the plug 20 and the ventilation channel 32 of the socket 21 into the interior of the housing of the device element 2. Similarly to the ventilation channel, the electrical conductors are also continued over the contact pins 23 and 24 and the contact sockets 25 and 26 and contacts located therein, which contact both the contact pins 23 and 24 as well as the electrical conductor 22, from the connecting piece into the housing of the device element 2. To continue the ventilation channel 37 in an air and water-tight fashion through the plug 20 and the socket 21, another sealing element 33 is present in the exemplary embodiment.

Reference is made here to the fact that the hearing aid device 1 according to FIG. 1 is only an exemplary embodiment. A plurality of possible solutions exist particularly with the design of the connection of the connecting piece 4 with the device element 2 or the earmold 3. In contrast to conventional solutions, which only provide one changeover of electrical conductors at the joints, the invention also additionally ensures a continuous ventilation channel.

Figure 3:
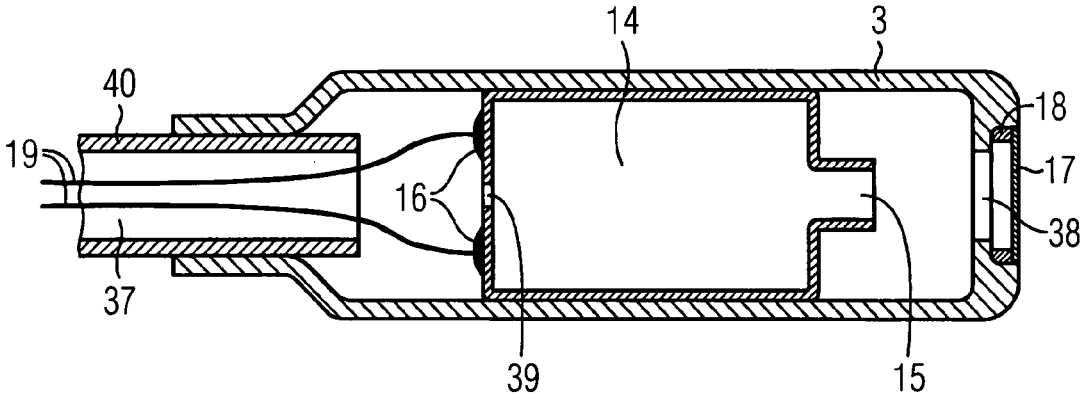
FIG. 3 shows an earmold, in which a receiver with a ventilation opening is located.

FIG. 3 shows an exemplary embodiment of the earmold 3. The entire earmold 3 is barely larger than the receiver 14 located therein and is thus particularly best suited to an open supply of a user. In order to achieve a closed supply, the earpiece 3 can also be individually molded according to the respective ear canal of the user or connected to a universally fitting earmold, in the form of a so-called "olive" for instance. It is also possible to use the earmold 3 according to FIG. 3 in a further earmold (not shown) which seals the auditory canal.

The earmold 3 according to FIG. 3 is fixedly connected to the tube 40, e.g. bonded. The earmold 3 is essentially embodied as a receiver 14 with a closely proximate tubular coating. The sound outlet opening 38 of the earmold 3 is shut off with an air and water-impermeable closed membrane 17. The infiltration of contamination, in particular cerumen and moisture into the receiver 14 is thus prevented. According to the exemplary embodiment, the membrane 17 is detachably connected to the earmold 3 by means of a membrane support 18. The detachable connection is embodied as a force fit for instance, so that the membrane 17 can be exchanged with the membrane support 18 by way of a suitable tool. In this process, a destruction of a membrane to be exchanged is accepted.

The earmold 3 resting closely against the receiver 14 and the air-tight sealing membrane 17 enable the enclosed volume between the receiver 14 and the membrane 17 to be enclosed in an air-tight manner. To ensure that the entire arrangement functions properly, the static pressure on both sides of the membrane 17 must however be equal. In the exemplary embodiment according to FIG. 3, a pressure equalization thus occurs via the high-precision borehole 39 in the housing of the receiver 14 and the sound outlet opening 15 of the receiver. A barometric pressure equalization between both sides of the receiver membrane is also ensured internally in the receiver, by means of small holes in the membrane for instance. A continuous connection from the enclosed volume between the receiver 14 and the membrane 17 into the interior of the device element 2 is herewith produced by way of the sound outlet opening 15 of the receiver, the high-precision borehole 39, the ventilation channel 27 and ventilation channels 31 and 32. As the device element 2 is not sealed in an air-tight fashion on its part by the air-permeable membrane 36, the barometric pressure equalization and/or the rear ventilation is herewith achieved for the membrane 17.

Unlike the embodiment illustrated, another acoustic tube could be provided between the sound outlet opening of the receiver 14 and the sound outlet opening in the earmold 3.

Figure 4:
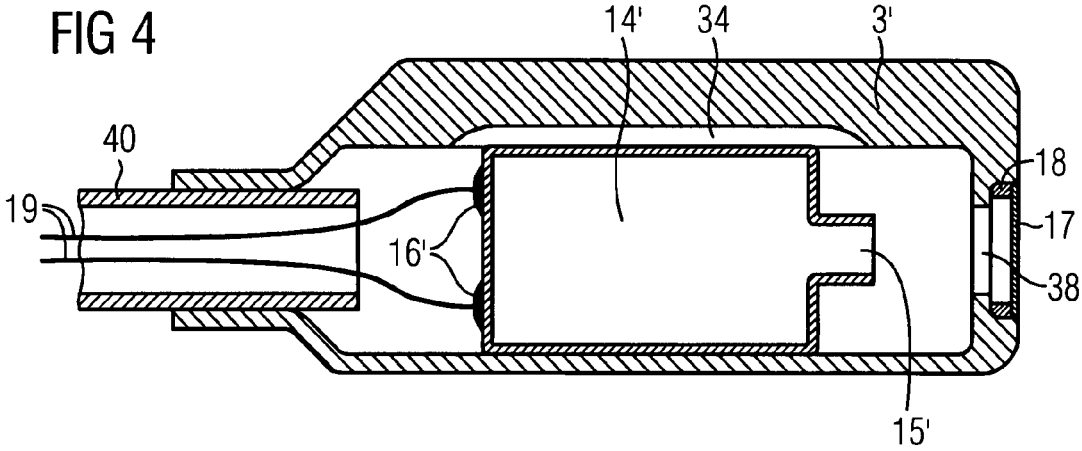
FIG. 4 shows an earmold, which comprises a connecting channel to the rear ventilation.

Another embodiment of the rear ventilation of the membrane 17 is shown in FIG. 4. In contrast to FIG. 3, the receiver 14' used here has no ventilation borehole in the receiver housing. To consequently achieve a rear ventilation of the membrane 17, the earmold 3' has a connecting channel 34, which creates an air-permeable channel between the front side of the receiver 14' with the sound outlet opening 15' and the rear side of the receiver 14' with the electrical receiver connecting contacts 15' past the housing of the receiver 14'. This alternative embodiment likewise achieves a rear ventilation of the membrane 17, even if a receiver 14' is used, in the housing of which no ventilation borehole is provided.

The invention claimed is:

1. A hearing aid device which can be worn by a user, comprising:

a device element wearable on or behind the ear of the user;

an earmold at least partially insertable into an auditory canal of the user;

an input converter that records an input signal and converts said signal into an electrical input signal;

a signal processing unit that amplifies the electrical input signal and generates an electrical output signal, the signal processing unit arranged in the device element;

a receiver that converts the electrical output signal into an acoustic output signal, the receiver arranged in the earmold;

a voltage source that supplies power to the hearing aid device; and a connecting piece that connects the device element to the eannold, the connecting piece comprising:

electrical conductors for the electrical connection of the signal processing unit with the receiver, and a first ventilation channel, wherein the earmold comprises a sound outlet opening covered with a water-impermeable membrane, wherein a continuous ventilation passage is established between the interior of the device element and a volume enclosed by the receiver and the membrane via the first ventilation channel, to provide barometric pressure equalization on both sides of the membrane.

2. The hearing aid device as claimed in claim 1, wherein the ventilation channel extends between the device element and the earmold, and wherein the ventilation channel opens into a housing of the device element at one end and on opens out in the earmold at another other end.

3. The hearing aid device as claimed in claim 2, wherein the connecting piece is connectable to the device element in a detachable fashion.

4. The hearing aid device as claimed in claim 3, wherein a connecting facility is present for the detachable electrical connection of the signal processing unit to the receiver and for the detachable connection of at least two segments of the ventilation channel.

5. The hearing aid device as claimed in claim 3, wherein the connecting facility includes a plug and socket.

6. The hearing aid device as claimed in claim 1, wherein the membrane is fastened to a membrane support which is connectable to the earmold in a detachable fashion.

7. The hearing aid device as claimed in claim 1, wherein the housing of the receiver comprises a ventilation borehole provided specially for the barometric pressure equalization.

8. The hearing aid device as claimed in claim 1, wherein the pressure equalization of the receiver takes place via the sound outlet opening of the receiver.

9. The hearing aid device as claimed in one of claim 1, wherein the earmold comprises a connecting channel that continues the ventilation channel for ventilating the enclosed volume between the receiver and the membrane.

10. The hearing aid device as claimed in claim 1, wherein the earmold is designed for an open supply of the user.

11. The hearing aid device as claimed in claim 1, wherein the overall hearing aid device is designed to be water-tight.

12. The hearing aid as claimed in claim 1, wherein the device element comprises a housing having an opening which is covered with an air-permuneable membrane.

13. The hearing aid as claimed in claim 1, further comprising a second ventilation channel connecting both sides of the receiver within the earmold, wherein said continuous ventilation passage between the interior of the device element and the volume enclosed by the receiver and the membrane is established via the first and second ventilation channels.

* * * * *